US011035523B2

(12) United States Patent
Jiang et al.

(10) Patent No.: US 11,035,523 B2
(45) Date of Patent: Jun. 15, 2021

(54) LIGHTING APPARATUS

(71) Applicant: XIAMEN ECO LIGHTING CO. LTD., Xiamen (CN)

(72) Inventors: Hongkui Jiang, Xiamen (CN); Hongbin Lin, Xiamen (CN); Jinyong Liu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/416,152

(22) Filed: May 18, 2019

(65) Prior Publication Data

US 2020/0363019 A1 Nov. 19, 2020

(51) Int. Cl.

| | |
|---|---|
| ***F21V 17/16*** | (2006.01) |
| ***F21K 9/23*** | (2016.01) |
| ***F21V 29/70*** | (2015.01) |
| ***F21V 5/04*** | (2006.01) |
| ***F21V 29/89*** | (2015.01) |
| ***F21V 3/02*** | (2006.01) |
| *F21Y 115/10* | (2016.01) |

(52) U.S. Cl.

CPC ..... *F21K 9/23* (2016.08); *F21V 3/02* (2013.01); *F21V 5/045* (2013.01); *F21V 17/164* (2013.01); *F21V 29/70* (2015.01); *F21V 29/89* (2015.01); *F21Y 2115/10* (2016.08)

(58) Field of Classification Search

CPC ..... F21K 9/23; F21V 17/164; F21V 29/89; F21V 29/70; F21V 3/02; F21V 5/045; F21Y 2115/10

See application file for complete search history.

(56) References Cited

U.S. PATENT DOCUMENTS

| | | | | |
|---|---|---|---|---|
| 9,255,702 | B2 * | 2/2016 | Singer | F21V 19/004 |
| 2006/0077667 | A1 * | 4/2006 | Lui | F21V 5/006 362/300 |
| 2009/0109687 | A1 * | 4/2009 | Householder | F21L 4/027 362/309 |
| 2009/0273934 | A1 * | 11/2009 | Secen | H01J 61/36 362/310 |
| 2010/0002453 | A1 * | 1/2010 | Wu | F21V 29/83 362/373 |
| 2010/0277067 | A1 * | 11/2010 | Maxik | F21V 3/00 315/32 |
| 2011/0028015 | A1 * | 2/2011 | Mostoller | H01J 5/50 439/280 |
| 2011/0149563 | A1 * | 6/2011 | Hsia | H01R 33/945 362/221 |
| 2012/0182737 | A1 * | 7/2012 | Kuenzler | F21V 19/003 362/249.02 |

(Continued)

FOREIGN PATENT DOCUMENTS

| | | | | |
|---|---|---|---|---|
| CN | 206582574 | * 10/2017 | ..... | F21K 9/232 |

*Primary Examiner* — Donald L Raleigh

(74) *Attorney, Agent, or Firm* — Chun-Ming Shih; Lanway IPR Services

(57) ABSTRACT

A lighting apparatus includes a light cover, a cup body, a heat sink, a light source module, a bulb cap and a driver. The cup body has a cup bottom, a cup top and a cup wall. The cup top has a larger diameter than the cup bottom. The light cover is attached to the cup top. The heat sink has a peripheral wall and a holder. The peripheral wall clings to the cup wall.

17 Claims, 4 Drawing Sheets

(56) References Cited

U.S. PATENT DOCUMENTS

| | | | | |
|---|---|---|---|---|
| 2013/0223061 | A1* | 8/2013 | Hwu | F21V 23/006 362/235 |
| 2014/0347852 | A1* | 11/2014 | Feit | F21K 9/23 362/235 |
| 2015/0098206 | A1* | 4/2015 | Pickard | F21K 9/60 362/84 |
| 2016/0040867 | A1* | 2/2016 | Chen | F21K 9/23 313/46 |
| 2019/0056085 | A1* | 2/2019 | Li | F21S 8/003 |

* cited by examiner

LIGHTING APPARATUS

FIELD

The present invention is related to a lighting apparatus and more particularly related to a LED lighting apparatus that has simple assembly design.

BACKGROUND

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

Indoor lighting is usually accomplished using light fixtures, and is a key part of interior design. Lighting can also be an intrinsic component of landscape projects.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY

According to an embodiment, a lighting apparatus includes a light cover, a cup body, a heat sink, a light source module, a driver and a bulb cap.

The cup body has a cup bottom, a cup top and a cup wall. The cup body may be made of plastic material like PC or other heat conductive material. Metal piece like aluminum piece may be wrapped in plastic material for a portion by molding process.

The cup body defines a containing space with a top opening at the cup top and a bottom opening at the cup bottom.

The cup top has a larger diameter than the cup bottom. In some embodiments, the cup wall has one or two curve lateral parts with a variation diameter from the cup top to the cup bottom.

The light cover is attached to the cup top. In some embodiments, the light cover has a substantial flat external surface facing outwardly. The flat external surface may have a curvature less than 30 degrees, e.g. with a par light style.

The heat sink has a peripheral wall and a holder. The peripheral wall surrounds the holder. The holder may be a disk plate.

The light source module is disposed on a first side of the holder facing to the light cover. The light source module may include a light source plate mounted with multiple LED modules. The light emitted from the light source module is transmitted through the light cover to outside. The light cover may be translucent or transparent so as light may be escaped through the light cover.

The bulb cap, e.g. a standard Edison cap, is attached to the cup bottom. The bulb cap has two electrodes for receiving an external power source. The driver is electrically connected to the two electrodes for converting the external power source to a driving current to the light source module.

The light source module generates heat. The heat is transmitted by the heat sink and the heat sink helps transmit the heat further to the cup body to efficiently perform heat dissipation. Under such design, the light source module is working in a stable environment.

In some embodiments, the light cover has a central lens and a peripheral ring. For example, there is a circular ring for light diffusion. the circular ring surrounds the central lens for producing a condensed light beam.

The central lens is disposed above the light source module and has a bottom wall enclosing LED chips of the light source module. Specifically, the bottom wall has a bottom end placed close to or engaging the light source module or the heat sink. Some or all LED chips are placed within a projecting area of the bottom wall of the central lens. The light emitted from the LED chips of the light source module is directed by the central lens.

In some embodiments, the central lens has a top convex lens and a bottom convex lens on both sides of the central lens.

In some embodiments, the driver may contain one or multiple components, e.g. integrated chips or capacitors. Some or all such components may be placed outside a projecting area of the central lens on the holder. For example, the LED chips are placed in the central place under the central lens while driver components are placed outside and around the LED chips of the light source module.

In some embodiments, the peripheral ring diffuses the light of the light source module, e.g. to refract lights to random directions to soften the output light while providing certain luminance.

In some embodiments, the peripheral wall has an external surface clinging to an inner surface of the cup wall. For example, the peripheral wall and the holder forms a cup with an opening facing upwardly. The peripheral wall clings to the cup wall for transmitting heat of the light source module for heat dissipation. Heat conductive glue or other heat conductive material may also be applied or inserted between the contact area of the peripheral wall and the cup body.

In some embodiments, the cup top has at least one first elastic inverted hook for being reformed when the heat sink enters into the cup body and for keeping the heat sink staying at a predetermined position with respect to the cup body.

For example, there are three first elastic inverted hooks disposed on the cup top. As mentioned above, the cup body may be made of plastic which has certain elastic characteristics, i.e. deforming under certain external force. The first inverted hooks have receiving ends, e.g. slope surface facing upwardly, for receiving the heat sink. When the heat sink moves along the first inverted hooks, the first inverted hooks are deformed. When the heat sink keeps moving and enters a predetermined position, the first inverted hooks may have a bottom side blocking the heat sink to escape.

With such design, screws may not be necessary and the installation may be easier.

In some embodiments, the cup wall wraps a metal piece, e.g. an aluminum piece. The metal piece is placed neighboring to the peripheral wall for enhancing heat dissipation. In other words, the heat of the light source module is transmitted from the heat sink to the surface of the cup body. The metal piece wrapped in the cup body further enhances heat dissipation.

In some embodiments, the light cover is fixed to the cup top by at least one second elastic inverted hook.

In some embodiments, the light source module has a light source plate fixed by at least one fastening structure extended from the holder. For example, the holder is a metal plate with some portion bent upwardly forming a hook to fix the light source plate of the light source module.

In some embodiments, the driver is placed at a second side of the holder. The second side is at an opposite side of the first side mentioned above.

In some embodiments, the lighting apparatus may also include an insulation cover enclosing the driver. For example, a sleeve to plug to the heat sink for enclosing exposed driver components.

In some embodiments, the cup body has a driver track for inserting and fixing a driver plate of the driver. For example, there are two tracks for receiving a corresponding driver plate for both positioning and for heat dissipation. The tracks may be made of heat conductive material.

In some embodiments, the two electrodes of the bulb cap are electrically connected to the light source module with two wires. For example, first ends of two wires are fixed to the two electrodes of the bulb cap. Then, second ends of the two wires, during manufacturing are fixed to the light source module or the driver before fixing the heat sink to the predetermined position. Then, the light cover is fixed to the cup top. Such design makes installation of the lighting apparatus easier.

In some embodiments, the two wires are plugged to the light source module with a plugging structure. For example, two plugging structures are prepared and disposed at the second ends of the wires. There are corresponding plugging structures, e.g. sockets, for plugging the two wires.

In some embodiments, the cup body is made of heat conductive material.

In some embodiments, the cup body is made of plastic material and the heat sink is made of metal material.

In some embodiments, the cup body has a screw socket for receiving a fixing screw for transmitting heat from the light source module to the screw socket.

DETAILED DESCRIPTION

Figure 1:
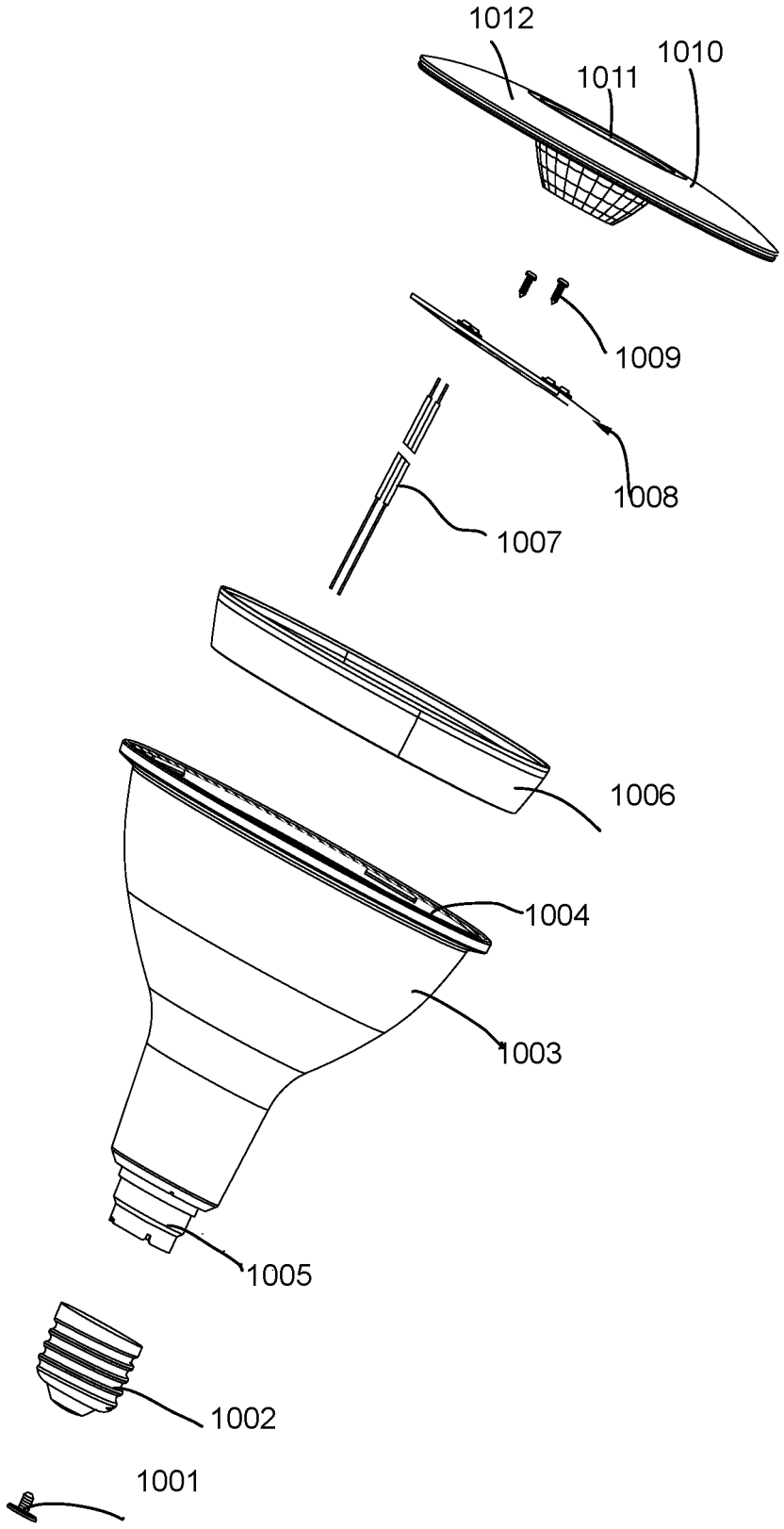
FIG. 1 is an exploded diagram of a lighting apparatus embodiment.
Figure 2:
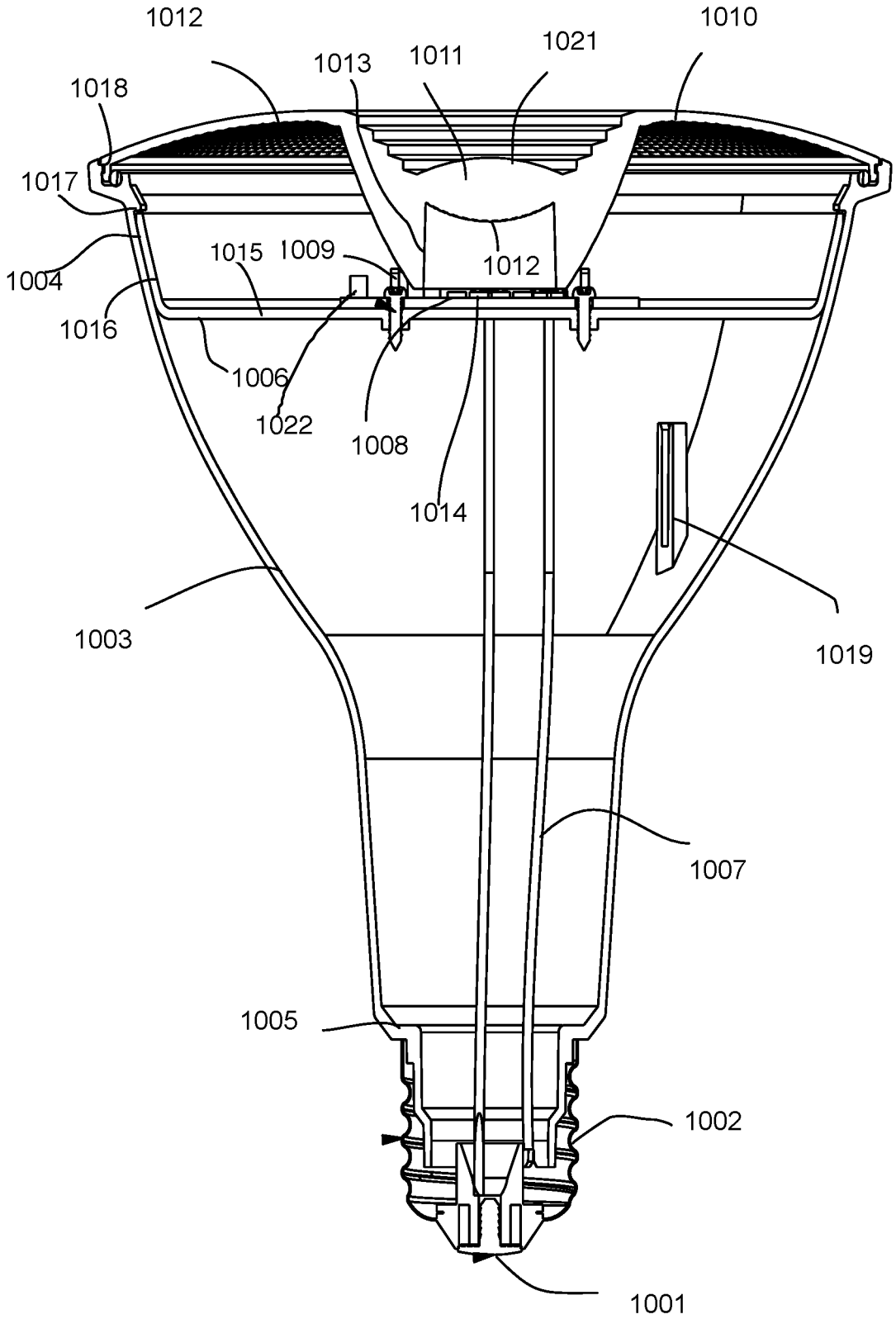
FIG. 2 is a cross-sectional view of the embodiment in FIG. 1.
Figure 3:
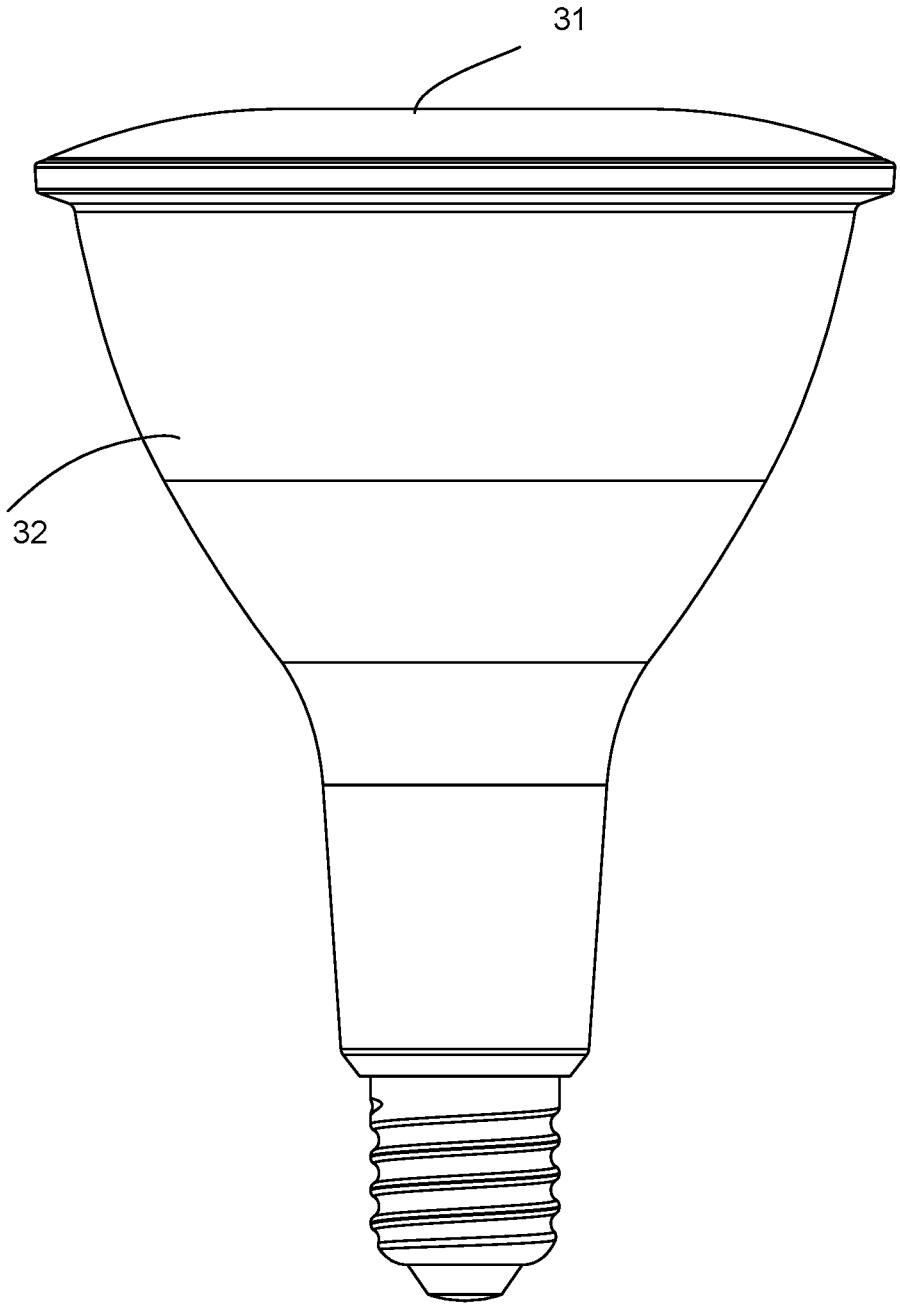
FIG. 3 is a side view of the embodiment of FIG. 1.

Please refer to FIG. 1, FIG. 2 and FIG. 3. FIG. 1 is an exploded diagram of a lighting apparatus embodiment. FIG. 2 is a cross-sectional view of the embodiment in FIG. 1. FIG. 3 is a side view of the embodiment of FIG. 1. Components with the same reference numerals indicate the same components in these drawings.

A lighting apparatus includes a light cover 1010, a cup body 1003, a heat sink 1006, a light source module 1008, a driver and a bulb cap.

The cup body has a cup bottom 1005, a cup top 1004 and a cup wall. The cup body 1003 may be made of plastic material like PC or other heat conductive material. Metal piece like aluminum piece may be wrapped in plastic material for a portion by molding process.

The cup body 1003 defines a containing space with a top opening at the cup top 1004 and a bottom opening at the cup bottom 1005.

The cup top 1004 has a larger diameter than the cup bottom 1005. In some embodiments, the cup wall has one or two curve lateral parts with a variation diameter from the cup top 1004 to the cup bottom 1005.

The light cover 1010 is attached to the cup top 1004. In some embodiments, the light cover 1010 has a substantial flat external surface 31 of the lighting apparatus example 32 facing outwardly as shown in FIG. 3. The flat external surface 31 may have a curvature less than 30 degrees, e.g. with a par light style.

Please refer to FIG. 2. The heat sink 1006 has a peripheral wall 1016 and a holder 1015. The peripheral wall 1016 surrounds the holder 1015. The holder 1015 may be a disk plate.

The light source module 1008 is disposed on a first side of the holder 1015 facing to the light cover 1010. The light source module 1008 may include a light source plate mounted with multiple LED chips 1014. The light emitted from the light source module 1008 is transmitted through the light cover 1010 to outside. The light cover 1010 may be translucent or transparent so as light may be escaped through the light cover 1010.

The bulb cap, e.g. a standard Edison cap, is attached to the cup bottom. The bulb cap has two electrodes 1001, 1002 for receiving an external power source. The driver is electrically connected to the two electrodes 1001, 1012 for converting the external power source to a driving current to the light source module 1008.

The light source module 1008 generates heat. The heat is transmitted by the heat sink 1006 and the heat sink 1006 helps transmit the heat further to the cup body 1003 to efficiently perform heat dissipation. Under such design, the light source module 1008 is working in a stable environment.

In some embodiments, the light cover 1010 has a central lens 1011 and a peripheral ring 1012, as illustrated in FIG. 1. For example, there is a circular ring for light diffusion. the circular ring surrounds the central lens 1011 for producing a condensed light beam.

The central lens 1011 is disposed above the light source module and has a bottom wall 1013 enclosing LED chips 1014 of the light source module 1008. Specifically, the bottom wall 1013 has a bottom end placed close to or engaging the light source module 1008 or the heat sink 1006. Some or all LED chips are placed within a projecting area of the bottom wall of the central lens. The light emitted from the LED chips 1014 of the light source module is directed by the central lens 1011.

In some embodiments, the central lens has a top convex lens 1021 and a bottom convex lens 1012 on both sides of the central lens.

In some embodiments, the driver may contain one or multiple components, e.g. integrated chips or capacitors. Some or all such components 1022 may be placed outside a projecting area of the central lens 1011 on the holder 1006. For example, the LED chips 1014 are placed in the central place under the central lens 1011 while driver components 1022 are placed outside and around the LED chips 1014 of the light source module 1008.

In some embodiments, the peripheral ring diffuses the light of the light source module, e.g. to refract lights to random directions to soften the output light while providing certain luminance.

In some embodiments, the peripheral wall has an external surface clinging to an inner surface of the cup wall. For example, the peripheral wall and the holder forms a cup with an opening facing upwardly. The peripheral wall clings to the cup wall for transmitting heat of the light source module for heat dissipation. Heat conductive glue or other heat conductive material may also be applied or inserted between the contact area of the peripheral wall and the cup body.

In some embodiments, the cup top has at least one first elastic inverted hook 401 for being reformed when the heat sink enters into the cup body and for keeping the heat sink staying at a predetermined position with respect to the cup body.

Figure 4:
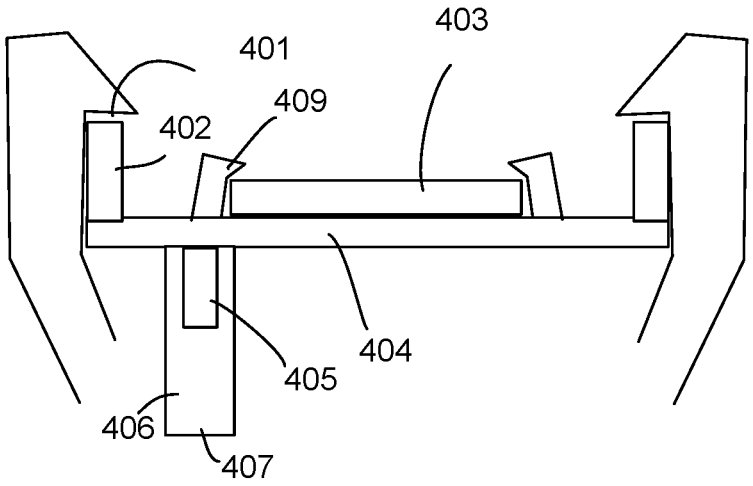
FIG. 4 is a diagram explaining some design features of other embodiments.

For an example of FIG. 4, there are three first elastic inverted hooks 401 disposed on the cup top. As mentioned above, the cup body may be made of plastic which has certain elastic characteristics, i.e. deforming under certain external force. The first inverted hooks 401 have receiving ends, e.g. slope surface facing upwardly, for receiving the peripheral wall 402 of the heat sink. When the peripheral wall 402 the heat sink moves along the first inverted hooks 401, the first inverted hooks 401 are deformed. When peripheral wall 402 of the heat sink keeps moving and enters a predetermined position, the first inverted hooks 401 may have a bottom side blocking the heat sink 401 to escape.

With such design, screws may not be necessary and the installation may be easier.

In some embodiments, the cup wall wraps a metal piece, e.g. an aluminum piece. The metal piece is placed neighboring to the peripheral wall for enhancing heat dissipation. In other words, the heat of the light source module is transmitted from the heat sink to the surface of the cup body. The metal piece wrapped in the cup body further enhances heat dissipation.

In some embodiments, the light cover is fixed to the cup top by at least one second inverted hook.

In some embodiments, the light source module has a light source plate fixed by at least one fastening structure extended from the holder. For the example in FIG. 4, the holder 404 is a metal plate with some portion 409 bent upwardly forming a hook to fix the light source plate 403 of the light source module.

In some embodiments, the driver is placed at a second side of the holder. The second side is at an opposite side of the first side mentioned above.

In some embodiments, the lighting apparatus may also include an insulation cover 407 enclosing the driver 405 in FIG. 4. For example, a sleeve 406 in FIG. 4 to plug to the heat sink for enclosing exposed driver components.

In some embodiments, the cup body has a driver track, e.g. the driver track 1019 in FIG. 1, for inserting and fixing a driver plate of the driver. For example, there are two tracks for receiving a corresponding driver plate for both positioning and for heat dissipation. The tracks may be made of heat conductive material.

In some embodiments, the two electrodes of the bulb cap are electrically connected to the light source module with two wires. For example, first ends of two wires are fixed to the two electrodes of the bulb cap. Then, second ends of the two wires, during manufacturing are fixed to the light source module or the driver before fixing the heat sink to the predetermined position. Then, the light cover is fixed to the cup top. Such design makes installation of the lighting apparatus easier.

In some embodiments, the two wires are plugged to the light source module with a plugging structure. For example, two plugging structures are prepared and disposed at the second ends of the wires. There are corresponding plugging structures, e.g. sockets, for plugging the two wires.

In some embodiments, the cup body is made of heat conductive material.

In some embodiments, the cup body is made of plastic material and the heat sink is made of metal material.

In some embodiments, the cup body has a screw socket for receiving a fixing screw for transmitting heat from the light source module to the screw socket.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light cover;

a cup body with a cup bottom, a cup top and a cup wall, the cup top having a larger diameter than the cup bottom, the light cover being attached to the cup top;

a heat sink made of a metal piece consisting of a peripheral wall and a holder, the peripheral wall surrounding the holder, wherein the holder is a metal plate;

a light source module disposed on a first side of the holder fixed by a hook made of a bent portion of the holder facing to the light cover, a light emitted from the light source module being transmitted through the light cover;

a driver enclosed by a sleeve plugged to the heat sink; and a bulb cap attached to the cup bottom, the bulb cap having two electrodes for receiving an external power source, the driver being electrically connected to the two electrodes for converting the external power source to a driving current to the light source module, wherein the peripheral wall has an external surface clinging to an inner surface of the cup wall, the peripheral wall has a flat inner surface opposite to the external surface, wherein the light source module has a light source plate fixed by at least one fastening structure extended from the holder, wherein the light source module has a light source plate fixed by at least one fastening structure to the holder for transmitting heat from the light source plate, to the holder, to the surrounding wall and then to the cup body.

2. The lighting apparatus of claim 1, wherein the light cover has a central lens and a peripheral ring.

3. The lighting apparatus of claim 2, wherein the central lens is disposed above the light source module and has a bottom wall enclosing LED chips of the light source module.

4. The lighting apparatus of claim 2, wherein the central lens has a top convex lens and a bottom convex lens on both sides of the central lens.

5. The lighting apparatus of claim 2, wherein a component of the driver is placed outside a projecting area of the central lens on the holder.

6. The lighting apparatus of claim 2, wherein the peripheral ring diffuses the light of the light source module.

7. The lighting apparatus of claim 1, wherein the cup top has at least one first elastic inverted hook for being reformed when the heat sink enters into the cup body and for keeping the heat sink staying at a predetermined position with respect to the cup body.

8. The lighting apparatus of claim 1, wherein the cup wall wraps a metal piece, the metal piece is placed neighboring to the peripheral wall for enhancing heat dissipation.

9. The lighting apparatus of claim 1, wherein the light cover is fixed to the cup top by at least one second elastic inverted hook.

10. The lighting apparatus of claim 1, wherein the holder has a plate disk shape.

11. The lighting apparatus of claim 1, wherein the driver is placed at a second side of the holder.

12. The lighting apparatus of claim 11, further comprising an insulation cover enclosing the driver.

13. The lighting apparatus of claim 11, wherein the cup body has a driver track for inserting and fixing a driver plate of the driver.

14. The lighting apparatus of claim 1, wherein the two electrodes of the bulb cap are electrically connected to the light source module with two wires.

15. The lighting apparatus of claim 14, wherein the two wires are plugged to the light source module with a plugging structure.

16. The lighting apparatus of claim 1, wherein the cup body is made of heat conductive material.

17. The lighting apparatus of claim 16, wherein the cup body is made of plastic material and the heat sink is made of metal material.

* * * * *